US006398583B1

(12) United States Patent
Zehren

(10) Patent No.: US 6,398,583 B1
(45) Date of Patent: Jun. 4, 2002

(54) APPARATUS AND METHOD FOR INSTALLING A DOWNHOLE ELECTRICAL UNIT AND PROVIDING ELECTRICAL CONNECTION THERETO

(76) Inventor: James N. Zehren, 1812 Arbor Dr., Bartlesville, OK (US) 74006

( * ) Notice: Subject to any disclaimer, the term of this patent is extended or adjusted under 35 U.S.C. 154(b) by 0 days.

(21) Appl. No.: 09/590,672

(22) Filed: Jun. 9, 2000

Related U.S. Application Data

(60) Provisional application No. 60/138,650, filed on Jun. 14, 1999.

(51) Int. Cl.[7] ..... H01R 13/66

(52) U.S. Cl. ..... 439/576; 439/521; 439/205

(58) Field of Search ..... 439/576, 190, 439/191, 192, 193, 194, 195, 199, 201, 202, 205, 206, 587, 588, 589, 592, 283, 138, 139, 140, 141, 521; 166/65.1, 381, 382, 242.6, 378

(56) References Cited

U.S. PATENT DOCUMENTS

| | | | | | |
|---|---|---|---|---|---|
| 3,468,258 | A | | 9/1969 | Arutunoff | 103/87 |
| 3,672,795 | A | | 6/1972 | Arutunoff | 417/424 |
| 3,853,430 | A | | 12/1974 | O'Rourke | 417/360 |
| 4,040,481 | A | * | 8/1977 | Coussan | 166/214 |
| 4,171,934 | A | | 10/1979 | Zehren | 417/360 |
| 4,304,452 | A | | 12/1981 | Kiefer | 339/75 |
| 4,331,203 | A | | 5/1982 | Kiefer | 166/339 |
| 4,373,767 | A | * | 2/1983 | Cairns | 439/275 |
| 4,391,330 | A | | 7/1983 | Kiefer | 166/341 |
| 4,438,996 | A | | 3/1984 | Zehren | 339/40 |
| 4,453,892 | A | | 6/1984 | Brookbank, III | 417/279 |
| 4,749,341 | A | | 6/1988 | Bayh, III | 417/360 |
| 4,799,546 | A | * | 1/1989 | Hensley et al. | 166/250 |
| 4,830,113 | A | | 5/1989 | Geyer | 166/369 |
| 4,913,239 | A | | 4/1990 | Bayh, III | 166/385 |
| 4,997,384 | A | | 3/1991 | Godfrey et al. | 439/190 |
| 5,007,852 | A | * | 4/1991 | Dean et al. | 439/201 |
| 5,070,940 | A | | 12/1991 | Conner et al. | 166/65.1 |
| 5,141,051 | A | * | 8/1992 | Lenhart | 166/65.1 |
| 5,145,007 | A | | 9/1992 | Dinkins | 166/386 |
| 5,305,830 | A | | 4/1994 | Wittrisch | 166/250 |
| 5,484,296 | A | * | 1/1996 | Taylor | 439/140 |
| 5,746,582 | A | | 5/1998 | Patterson | 417/53 |
| 5,820,416 | A | * | 10/1998 | Carmichael | 439/668 |
| 5,871,052 | A | * | 2/1999 | Benson et al. | 166/386 |
| 5,927,402 | A | * | 7/1999 | Benson et al. | 166/65.1 |
| 5,938,246 | A | * | 8/1999 | Wallace et al. | 285/351 |
| 5,967,816 | A | * | 10/1999 | Sampa et al. | 439/190 |

* cited by examiner

*Primary Examiner*—P. Austin Bradley
*Assistant Examiner*—Ross Gushi
(74) *Attorney, Agent, or Firm*—Miles & Stockbridge P.C.

(57) ABSTRACT

Cooperable female and male connectors are used to install and provide electrical connection to a downhole electrical unit such as an electrically driven pump. The female connector has a housing with a longitudinal passage, at a lower end portion of which longitudinally spaced circumferential contacts of a first set are exposed internally. A downhole assembly including the electrical unit is suspended from the female connector and is lowered into a well on a running tool. The downhole assembly is locked in position in the well, and the running tool is pulled from the well. Then a male connector is lowered into the well on an electric cable. The male connector has a second set of longitudinally spaced circumferential contacts, externally, adapted to engage corresponding contacts of the first set. The contacts of the male connector are connected to conductors of the electric cable. The male connector is inserted into the passage of the female connector, a protective cover of the second set of contacts is moved away to permit the contacts of the male connector to engage corresponding contacts of the female connector.

21 Claims, 6 Drawing Sheets

APPARATUS AND METHOD FOR INSTALLING A DOWNHOLE ELECTRICAL UNIT AND PROVIDING ELECTRICAL CONNECTION THERETO

CROSS-REFERENCE TO RELATED APPLICATION:

This application takes the benefit of Provisional Application No. 60/138,650 filed Jun. 14, 1999, incorporated herein by reference.

BACKGROUND OF THE INVENTION

This invention is concerned with installing a downhole electrical unit, such as a submersible electrically operated pump, and providing electrical connection thereto.

Current new overseas wells that require artificial lift use coiled-tubing-deployed submersible pumps. This requires a large amount of installation equipment and a large number of personnel to operate the equipment. Installing or pulling the submersible pumps is time consuming and expensive.

BRIEF DESCRIPTION OF THE INVENTION

The present invention provides an improved apparatus and method for installing a downhole electrical unit, such as an electrically energized submersible pump, and providing electrical connection thereto. The invention does not require coiled tubing, and it substantially reduces the amount of equipment and the number of personnel required.

In a preferred embodiment, the invention uses cooperable female and male connectors that are run into a well successively. A downhole assembly including the electrical unit is provided with the female connector at its upper end and is lowered into a well on a running tool, preferably attached to the female connector by shear pins. When the downhole assembly is set in the well and locked in position, the running tool is pulled by first breaking the attachment to the female connector. Then the male connector is run into the well on an electric cable and is inserted into the female connector. Longitudinally spaced internal contacts of the female connector are engaged with corresponding longitudinally spaced external contacts of the male connector. Conductors provide electrical connection between the electrical unit and the contacts of the female connector. Conductors of the electric cable provide electrical connection between the contacts of the male connector and electrical equipment above the well.

BRIEF DESCRIPTION OF THE DRAWINGS

The invention will be further described in conjunction with the accompanying drawings, which illustrate preferred and exemplary (best mode) embodiments, and wherein.

DETAILED DESCRIPTION OF THE INVENTION

Figure 1:
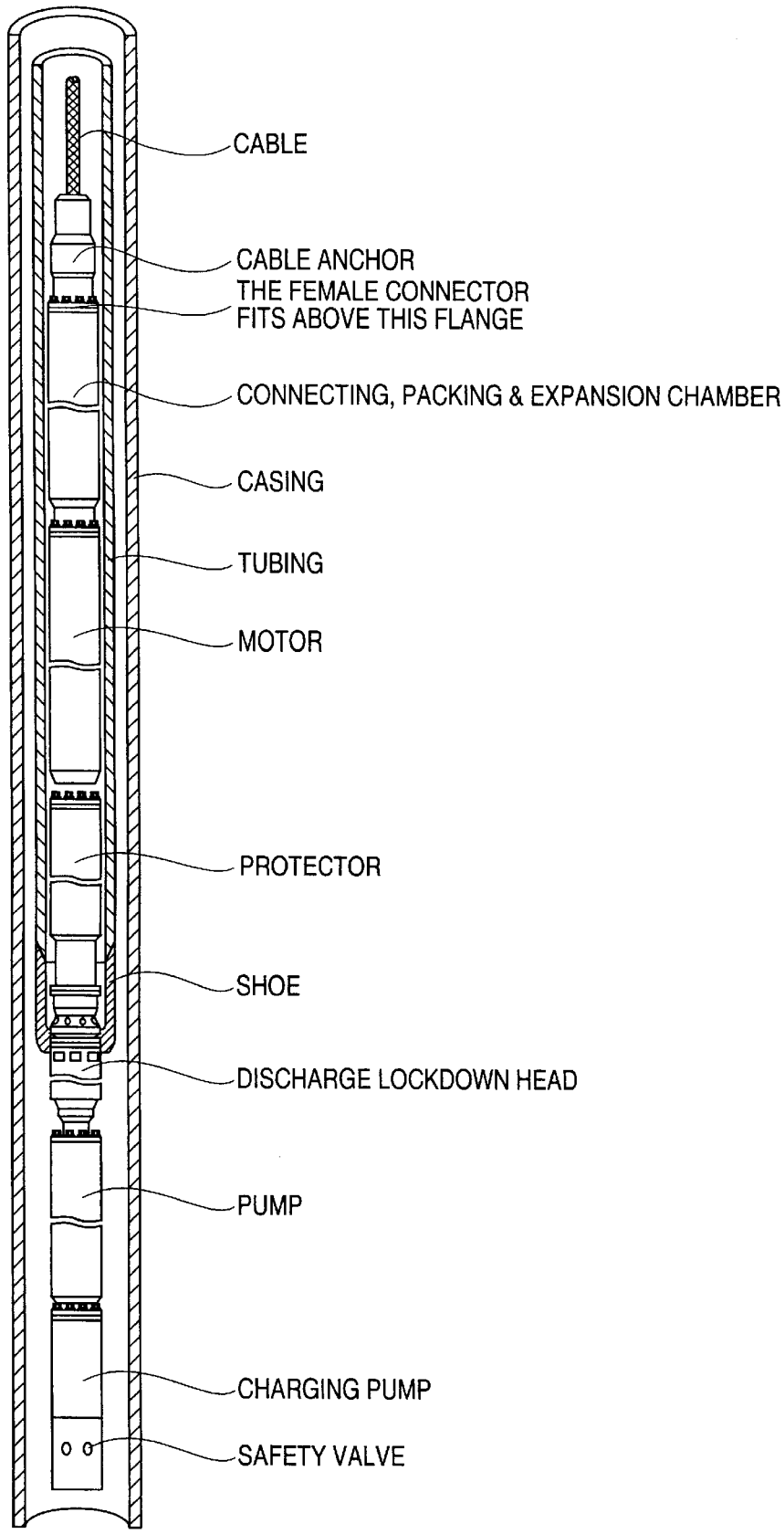
FIG. 1 is a diagrammatic view showing a conventional downhole installation.

FIG. 1 shows a conventional downhole assembly installed on a shoe at the bottom of tubing suspended from a wellhead (not shown) in a well casing. Instead of using the tubing, the shoe can be attached to a casing liner or to the casing itself, as is well known. in the form shown, the downhole assembly comprises a cable anchor at its upper end, from which are suspended a connecting, packing & expansion chamber, an electric motor, a protector, a discharge lockdown head, a submersible pump, a charging pump, and a safety valve, all as well known. The downhole assembly is not limited to that shown and may comprise various components in various arrangements, as needed. In the present invention, the cable anchor and its cable are eliminated, as will become apparent in the following description.

The present invention employs cooperable female and male connectors referred to earlier. The female connector 10, shown in FIG. 2, comprises an elongated cylindrical housing 12 secured, as by threads, to upper and lower bodies 14 and 16. The lower body has a flange 18 through which bolts 20 are threaded into an upper body 22 of a next component 24 of the downhole assembly, in this case the connecting, packing & expansion chamber shown in FIG. 1. The upper body 14 of the female connector has a circumferential shear pin groove 26 for engagement with shear pins of a running tool.

The housing 12 has a central passage 28 with a tapered lower end portion 30, the diameter of which is reduced from top to bottom. A first set of longitudinally spaced, circumferentially extending internally exposed contacts 32 is provided at the tapered portion of the passage. Insulating blocks 34 are provided above, below, and between the contacts. The contacts and intervening insulating blocks are supported in an insulating tube 36 within the housing.

The contacts and the insulating blocks have cavities 28 or passages 40 through which conductors 41 extend from the electrical unit to terminals 42 of the contacts. Locating pins 44 are provided for ensuring alignment of the cavities of the contacts and passages through the insulating blocks. The conductors extend through a tube 46 in a packing 48 in the lower body 16 of the female connector, the packing being held in place by a plug 50 bolted to the lower body. The conductors extend through openings in a sleeve 52 mounted on the lower body below the bottom insulating block.

Figure 3:
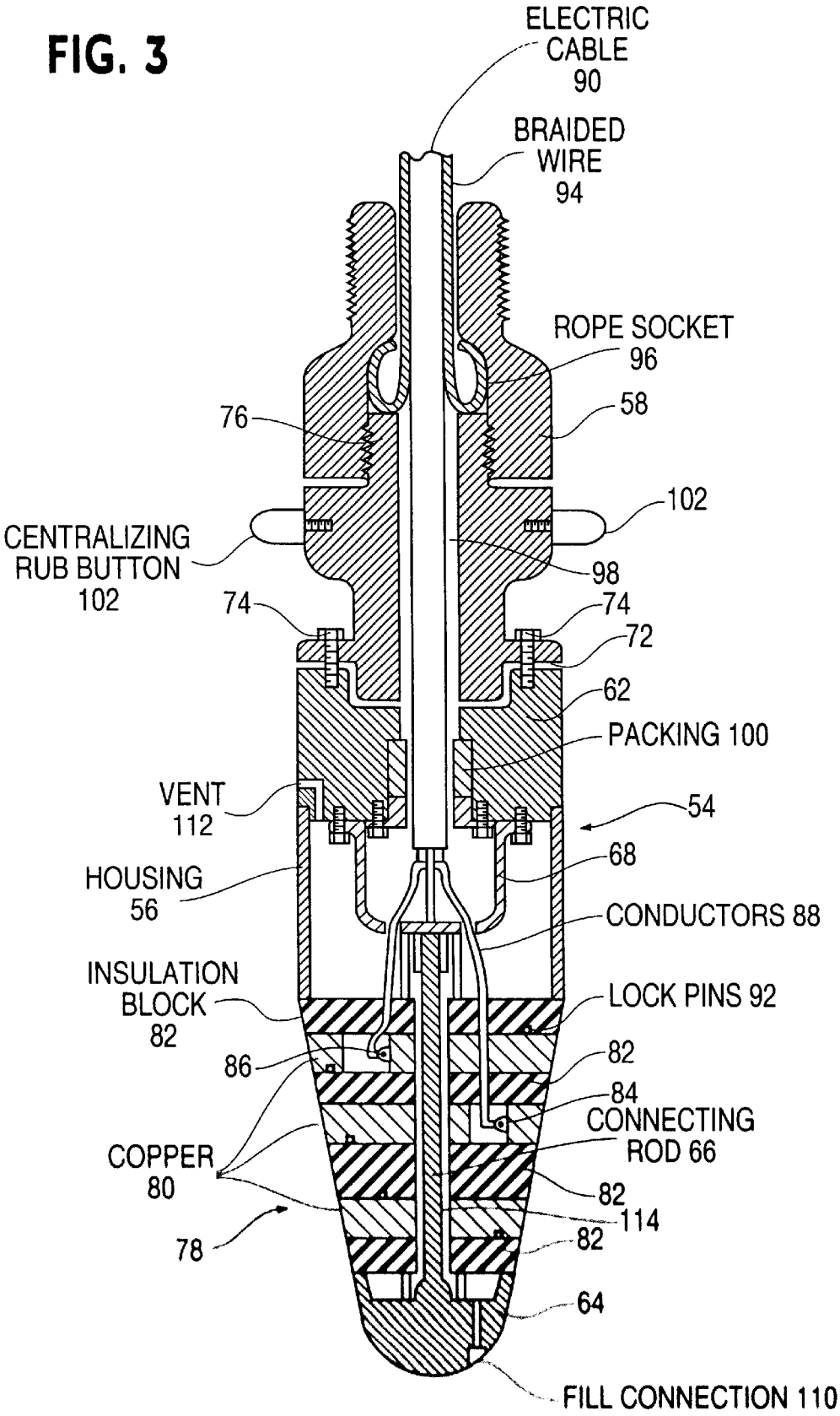
FIG. 3 is a longitudinal sectional view of a male connector employed in the invention.
Figure 4:
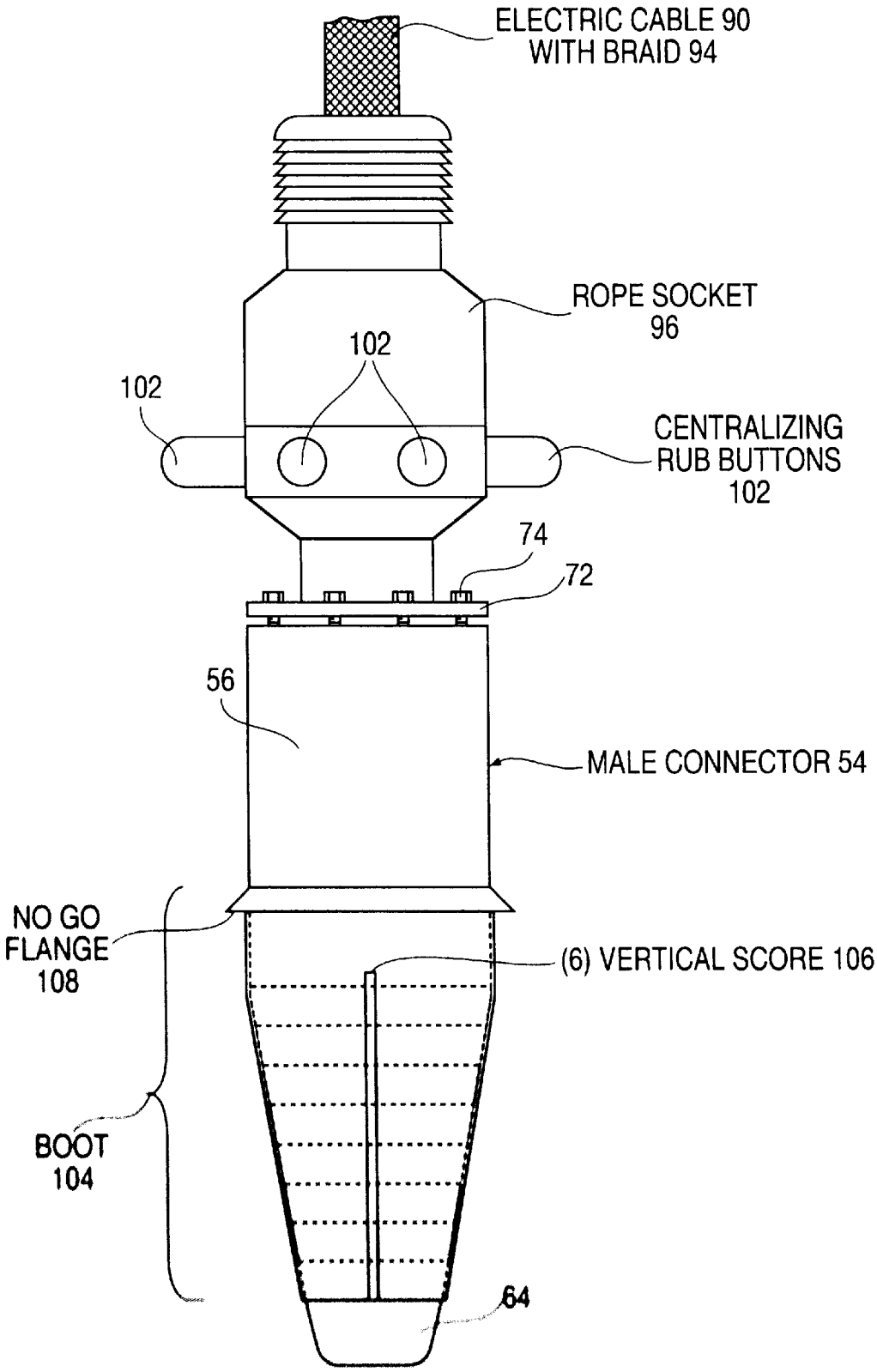
FIG. 4 is a side elevation view of the male connector.

The male connector 54, shown in FIGS. 3 and 4, comprises a cylindrical housing 56 with a multi-section upper body 58, 60, 62 and a lower body 64 connected to the bottom section 62 of the upper body by a connecting rod 66. The bottom section 62 of the upper body has a cup 68, bolted thereto, with a depending nipple 70 into which the connecting rod is threaded. An intermediate section of the upper body has a flange 72 through which bolts 74 are threaded into the bottom section 62 and has a nipple 76 at its upper end threaded into the lower end of the top section 58.

The male connector has a tapered lower end portion 78 below the housing 56, the diameter of which is reduced from top to bottom. The lower end portion 78 has a second set of longitudinally spaced circumferentially extending contacts 80 and longitudinally spaced insulation blocks 82 above, below, and between the contacts. The insulation blocks and contacts are held in place between the lower body 64 and the housing 56 by the connecting rod 66. The contacts have cavities 84 (two of which are shown in FIG. 3) that contain contact terminals 86 for connection to conductors 88 of an electric cable 90. Passages are provided through the insulation blocks where required for passage of the conductors. Locating (lock) pins 92 are provided to ensure alignment of passages in the insulation blocks and cavities in the contacts.

Figure 2:
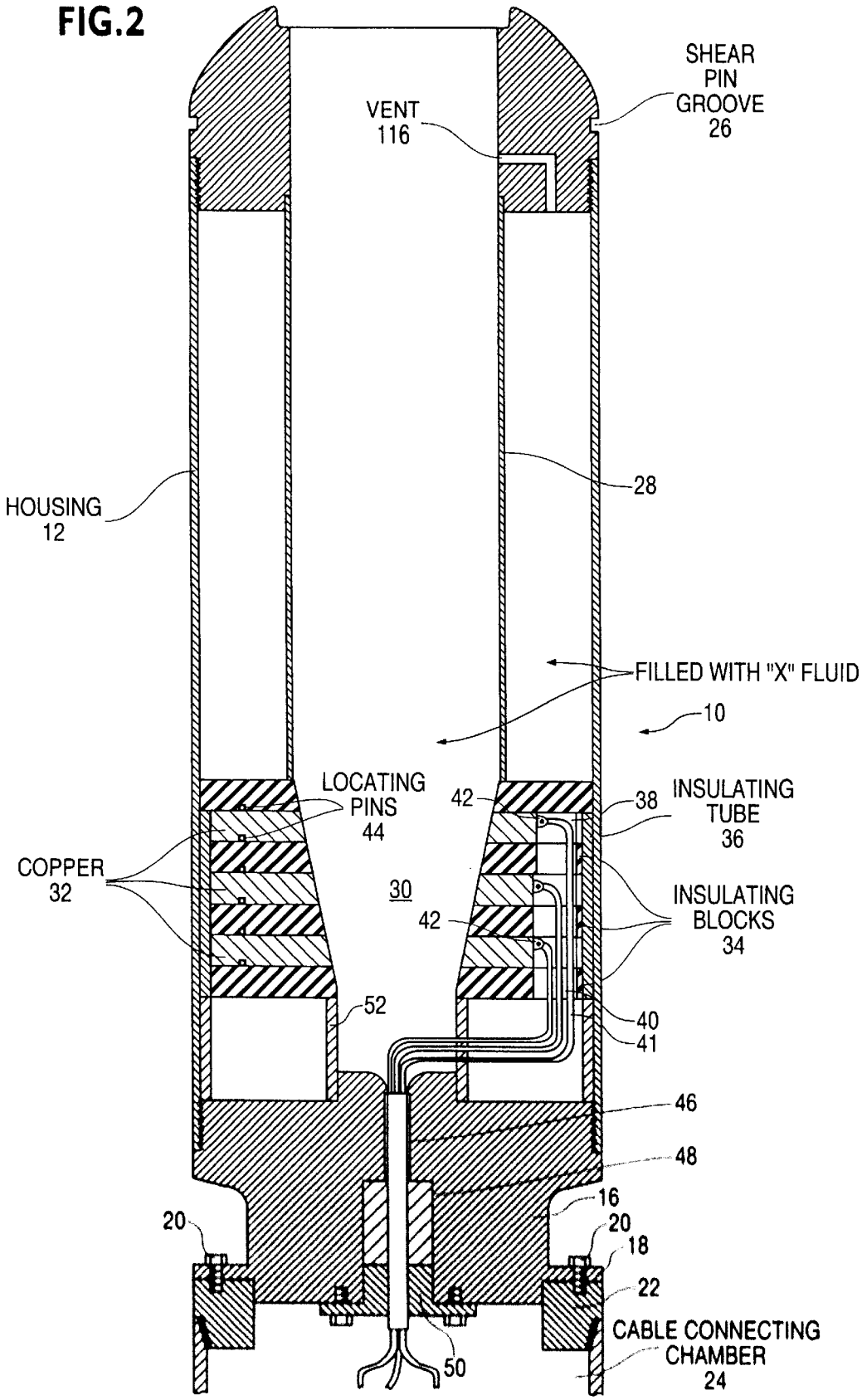
FIG. 2 is a longitudinal sectional view of a female connector employed in the invention.

The electric cable used in the invention may be a standard electric submersible cable without the normal armor. The armor may be replaced by a braided monel wire sheath 94 having sufficient strength to carry the weight of the cable and the weight of the male connector (plus a safety factor) and serving as a mechanical protector of the cable. As shown in FIG. 2, the sheath terminates in a conventional rope socket 96 in the top section 58 of the upper body. The lower end of the electric cable extends downwardly through a passage 98 in the intermediate section 60, and through a packing 100 in the bottom section 62 to a position within the cup 68, where the individual conductors of the cable are separated and extend through holes in the bottom of the cup as shown.

In the preferred form, the intermediate section 60 of the upper body of the male connector has outwardly projecting radial rub buttons 102 that serve as a centralizing guide when the male connector is lowered into the well. The lower end portion 78 of the male connector is provided with a protective covering 104, which may be in the form of a tapered rubber boot having circumferentially spaced vertical lines of weakness 106 (e.g., vertical scores), one of which is shown in FIG. 4, and a no go top flange 108. The boot protects the contacts of the male connector during the lowering of the male connector into the well.

Both the male and female connectors are provided with a protective fluid system. As shown in FIG. 3, this system of the male connector includes a fill connection 110 at one end and a vent 112 at an opposite end. Intermediate portions of the system include a passage 114 surrounding the connecting rod, connections to the cavities in the contacts, and connections to the inside of the housing and the inside of the cup. The protective fluid system of the female connector includes a vent 116 at an upper end of the housing, as well as connections to the cavities of the contacts and insulating blocks and to the interior of the housing (and the passage 28 therein).

A typical procedure using the female and male connectors of the invention for installing a downhole electrical unit and providing electrical connection thereto will now be described.

As in a standard downhole installation, appropriate components of the downhole assembly are filled with oil. The assembly may take the form shown in FIG. 1, for example, with the female connector bolted to a connecting, packing and expansion chamber at the upper end. Before the downhole assembly is lowered into the well, the female connector is filled with a protective fluid ("X" fluid) that has good dielectric properties and that will not mix with brine water or hydrocarbons in the well.

Figure 5:
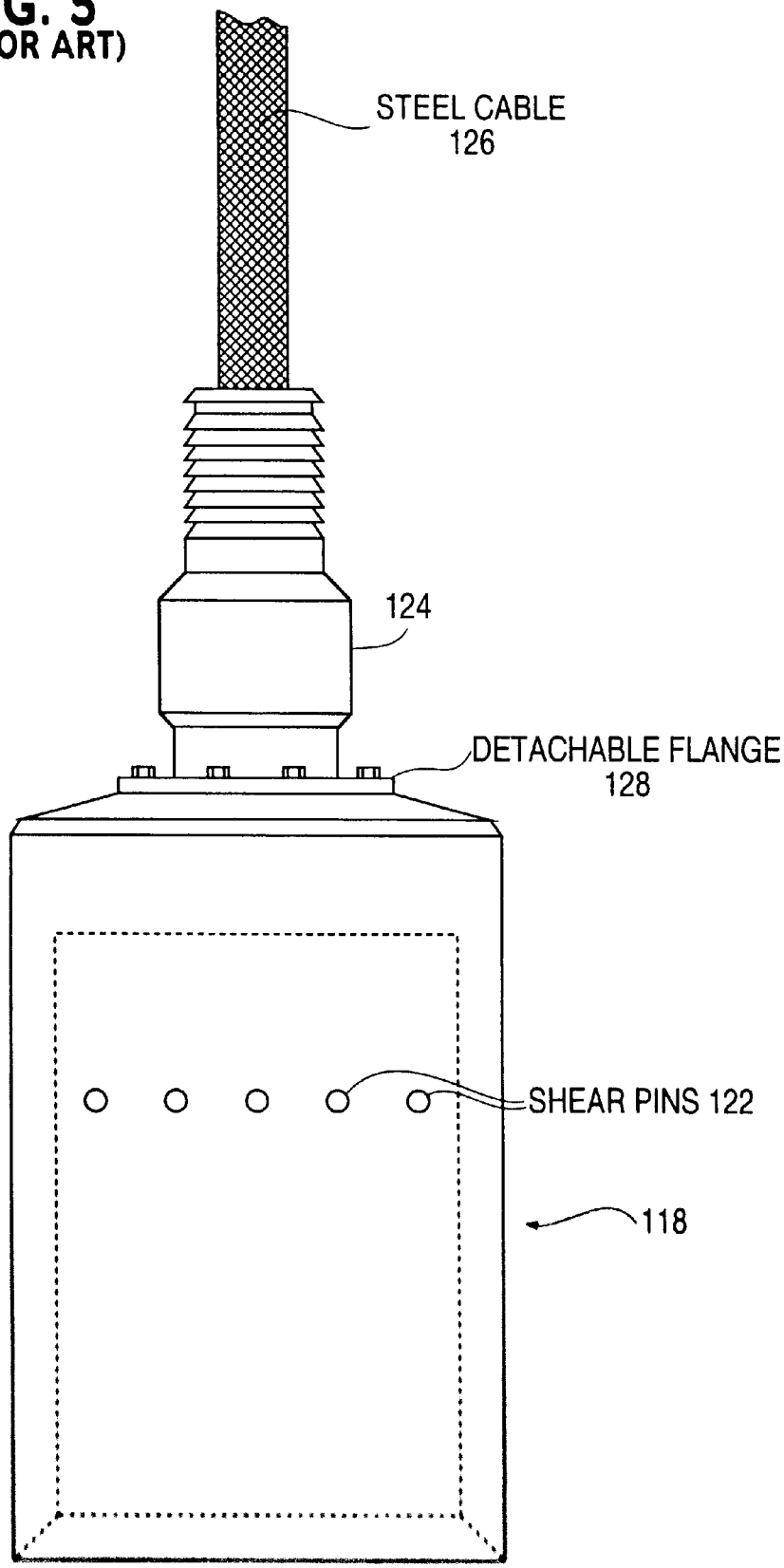
FIG. 5 (PRIOR ART)
FIG. 5 is a side elevation view of a running tool employed in the invention.

After the female connector is filled, a running tool 118, such as that shown in FIG. 5, is attached to the upper body of the female connector. The running tool has a cylindrical shell 120, open at its bottom, and is provided with radial shear pins 122 that are inserted into the shear pin groove 26 in the upper body 14 of the female connector after the shell 120 of the running tool is placed over the housing 12 of the female connector. The running tool has a rope socket 124 attached to a steel cable 126 and provided with a flange 128 by which the rope socket is bolted to the shell of the running tool.

A standard double-drum work-over unit with a pole mast can be used to put together the downhole assembly. One of the drums can hold the steel cable used in running and installing the downhole assembly, and also used in pulling the downhole assembly as later described. The other drum can hold the electrical submersible cable attached to the male connector.

After the running tool 118 is attached to the female connector 10, the downhole assembly is lowered into a well until it reaches a desired depth, whereupon a discharge lock-down head such as that shown in FIG. 1 is activated conventionally to lock the downhole assembly in position in the well. The discharge lock-down head can also be provided with shear pins, the number and/or total strength of which exceed the number and/or total strength of the shear pins of the running tool. For example, the shear pins of the lock-down discharge head may be of the type disclosed in U.S. Pat. No. 4,171,934, for example (incorporated herein by reference), shear pins 116 being shown in FIG. 2 of the patent, with descriptive details given in column 5, lines 14–25.

After the downhole assembly has been locked in position in the well, by activation of the discharge lock-down head, the running tool 118 is pulled from the well by exerting a pulling force on the steel cable 126 sufficient to break the shear pins 122 connecting the running tool to the female connector, leaving the downhole assembly in place.

Then the male connector 54 is run into the well on its electric cable 90. As the male connector is lowered into the well, the centralizing rub buttons 102 perform two functions: (1) they assist in insertion of the male connector into the female connector; and (2) they keep the no go flange 108 of the boot on the male connector from rubbing the tubing (or the liner or casing) during installation.

When the male connector enters the female connector, the no go flange 108 at the top of the boot 104 engages a shoulder 130 at the top of the female connector, and as the male connector continues insertion into the female connector, the boot 104 tears at the lines of weakness 106, exposing the contacts of the male connector as the male connector moves downwardly through the boot. Ultimately, the male connector is seated in the female connector with contacts of the male connector engaging corresponding contacts of the female connector. Electrical connections are thus established between the downhole electrical unit and electrical equipment above the well via the electric cable.

Figure 6:
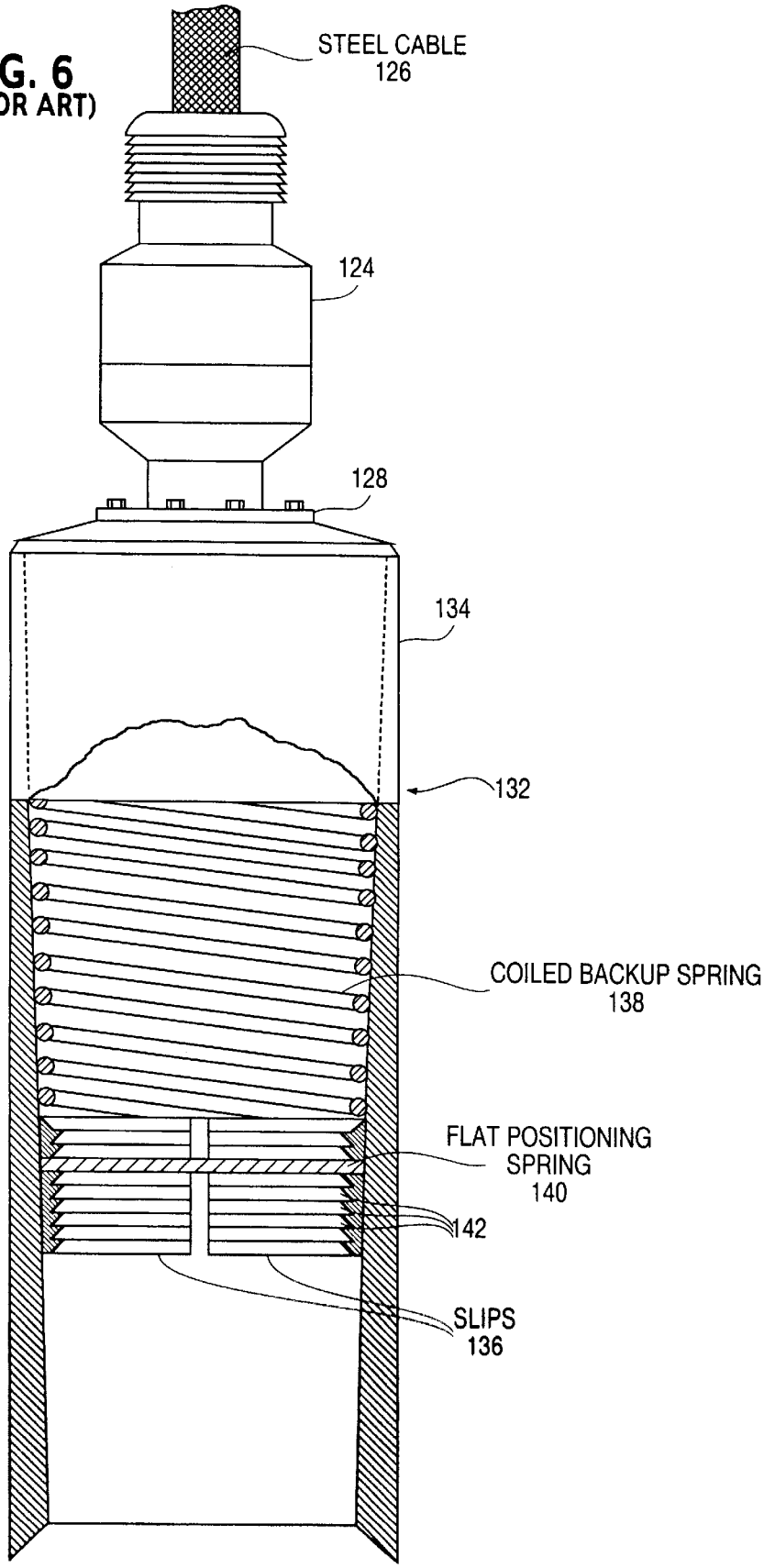
FIG. 6 (PRIOR ART)
FIG. 6 is a partly sectional side elevation view of a retrieving (pulling) tool that may be employed in the invention.

When it is desired to pull the downhole assembly from the well, a retrieving (pulling) tool 132 such as that shown in FIG. 6 can be used. In this embodiment, the flange 128 attached to the running tool 118 in FIG. 5 is instead bolted to the top of a cylindrical shell 134 of the retrieving tool. In the form shown, the interior of the shell of the retrieving tool is tapered (as by tapered wall thickness) so that the diameter of the interior of the shell is reduced toward the lower end of the shell. Wedging slips, two of which are shown in FIG. 6, but the number of which may be varied, are held in place by a coil spring 138 and by a flat circumferential positioning spring 140 received in a groove of the slips.

To retrieve the downhole assembly, the shell 134 of the retrieving tool 132 is lowered over the upper body 14 of the female connector, which is received within the slips 136. Internal serrations 142 of the slips grip the upper body of the female connector, and when a pulling force is applied to the steel cable 126 sufficient to break the shear pins holding the downhole assembly in place, the shell 134 of the retrieving tool moves upwardly relative to the slips 136. The wedging action between the shell and the slips causes the slips to grip the upper body of the female connector with sufficient force to ensure the breaking of the shear pins of the downhole assembly and the retrieval of the downhole assembly from the well.

While preferred embodiments of the invention have been shown and described, it will be apparent to those skilled in the art that changes can be made without departing from the principles and spirit of the invention, the scope of which is defined in the appended claims. For example, the downhole electrical unit may take various forms (such as a telemetry unit) and is not limited to an electrically driven submersible pump.

What is claimed is:

1. Apparatus for installing a downhole electrical unit and providing electrical connection thereto, comprising:

a first connector having a housing constructed to suspend the electrical unit therefrom and having a first set of contacts spaced longitudinally in the housing and adapted to be connected to the electrical unit; and a second connector constructed to be lowered into the housing of the first connector and having a second set of contacts spaced longitudinally of the second connector and disposed to engage corresponding contacts of the first set, the second set of contacts being adapted to be connected to conductors of an electric cable, wherein the second connector has a device constructed to engage the electric cable and to suspend the second connector from the electric cable to lower the second connector into the first connector, and wherein the second connector has a boot that covers the second set of contacts and that is constructed to engage the first connector and thereby to uncover the second set of contacts as the second connector is inserted into the housing of the first connector.

2. Apparatus according to claim 1, wherein the boot is flexible and is constructed to tear as it engages the first connector.

3. Apparatus according to claim 1, wherein the first connector is a female connector and the second connector is a male connector, wherein the housing of the female connector has a longitudinal passage therein for insertion of the male connector at an upper portion of the passage, a lower portion of the passage being tapered to provide a cross-section that decreases toward a lower end of the female connector, wherein the contacts of the first set are exposed in the lower portion, and wherein the passage is constructed to receive and hold protective fluid therein.

4. Apparatus according to claim 3, wherein the male connector has an upper portion constructed to engage the electric cable and a lower portion that is tapered to complement the taper of the lower portion of the passage of the female connector, and wherein the contacts of the second set are exposed at an outer surface of the tapered portion of the male connector that is covered by the boot.

5. Apparatus according to claim 4, wherein the boot has a tapered portion that surrounds the tapered portion of the male connector.

6. Apparatus according to claim 5, wherein the boot has an external flange at an upper end portion of the boot that is constructed to engage an upper end portion of the female connector when the male connector is inserted into the passage of the female connector, so that after the boot enters the protective fluid further entry of the boot into the passage of the female connector is stopped, and wherein the boot is constructed to open as the male connector is further inserted into the passage of the female connector, whereby the contacts of the second set are exposed to engage the contacts of the first set when the tapered portions of the male and female connectors are contiguous.

7. Apparatus according to claim 6, wherein the boot is formed of flexible material that tears to open the boot.

8. A method of installing and providing electrical connection to a downhole electrical unit, comprising:

providing a downhole assembly including the electrical unit and a first connector from which the electrical unit is suspended, the first connector having a housing with a first set of contacts therein spaced longitudinally of the housing and connected to the electrical unit;

attaching a running tool to the first connector and lowering the downhole assembly into a well on the running tool;

setting the downhole assembly in the well;

detaching the running tool from the first connector and pulling the running tool from the well;

lowering a second connector into the well suspended on an electric cable, the second connector having a second set of longitudinally spaced contacts connected to conductors of the electric cable and being adapted to engage corresponding contacts of the first set; and inserting the second connector into the first connector and engaging the corresponding contacts of the connectors, wherein the contacts of the second connector are covered by a boot during lowering of the second connector into the well, and wherein the covering of the contacts of the second connector by the boot is terminated as the second connector is inserted into the first connector so that the contacts of the second connector are exposed for engagement with the contacts of the first connector.

9. A method according to claim 8, wherein the boot is flexible and is constructed to tear by engaging the first connector as the second connector is inserted into the first connector.

10. A method of installing and providing electrical connection to a downhole electrical unit, comprising:

providing a female connector having a housing with a set of contacts therein spaced longitudinally of the housing and connected to the electrical unit;

providing protective fluid in the housing to cover portions of the contacts of the first set in the housing;

setting the female connector in a well;

providing a male connector adapted to be inserted in the female connector and having a second set of contacts spaced longitudinally of the male connector;

suspending the male connector from an electric cable, with conductors of the electric cable connected to the second set of contacts;

lowering the male connector into the well suspended on the electric cable, the contacts of the second set being protected from well fluid by a covering during lowering of the male connector into the well;

inserting the male connector into the female connector, such that the covering is moved into the protective fluid in the housing of the female connector;

providing relative movement between the covering and the contacts of the second set to expose the contacts of the second set in the protective fluid; and engaging the second set of contacts with the first set of contacts.

11. A method of installing and providing electrical connection to a downhole electrical unit, comprising:

providing a downhole assembly including the electrical unit and a first connector from which the electrical unit is suspended, the first connector having a housing with a first set of contacts therein spaced longitudinally of the housing and connected to the electrical unit;

attaching a running tool to the first connector and lowering the downhole assembly into a well on the running tool;

setting the downhole assembly in the well;

detaching the running tool from the first connector and pulling the running tool from the well;

lowering a second connector into the well suspended on an electric cable, the second connector having a second set of longitudinally spaced contacts connected to conductors of the electric cable and being adapted to engage corresponding contacts of the first set;

inserting the second connector into the first connector and engaging the corresponding contacts of the connectors, wherein the contacts of the second set are protected from well fluid by a covering during lowering of the second connector to the first connector and wherein the covering is moved to expose the contacts of the second set as the second connector is inserted into the first connector; and wherein the covering is flexible and is constructed to tear by engagement with the first connector.

12. A downhole male connector adapted to be inserted in a downhole female connector, comprising:

an upper portion constructed to engage a sheath of an electric cable and to suspend the male connector therefrom;

a lower portion that tapers to provide a cross-section that decreases toward a lower end of the male connector;

a set of longitudinally spaced external circumferential contacts on the lower portion; and a boot surrounding the lower portion and having a taper that complements the taper of the lower portion.

13. A downhole male connector according to claim 12, wherein the boot has an external flange at an upper end portion thereof for engaging an upper end portion of the female connector when the male connector is inserted in the female connector, thereby to limit insertion of the boot into the female connector, wherein the boot is formed of flexible material constructed to tear to open the boot when the flange engages the upper end portion of the female connector and the male connector is further inserted into the female connector, so that the contacts of the male connector are exposed.

14. A downhole male connector according to claim 12, further comprising a protective fluid system including a housing that is constructed to receive and hold protective fluid therein and to provide protective fluid to cavities in the contacts of the male connector that contain terminals for electrical connection to conductors of the electric cable.

15. A method of installing and providing electrical connection to a downhole electrical unit, comprising:

providing a downhole assembly including the electrical unit and a first connector from which the electrical unit is suspended, the first connector having a housing containing protective fluid with a first set of contacts therein spaced longitudinally of the housing in the protective fluid and connected to the electrical unit;

attaching a running tool to the first connector and lowering the downhole assembly into a well on the running tool;

setting the downhole assembly in the well;

detaching the running tool from the first connector and pulling the running tool from the well;

lowering a second connector into the well suspended on an electric cable, the second connector having a second set of longitudinally spaced contacts connected to conductors of the electric cable and being adapted to engage corresponding contacts of the first set, the contacts of the second set being protected from well fluid by a covering during lowering of the second connector into the well;

inserting the second connector into the first connector such that the covering is moved into the protective fluid of the first connector;

providing relative movement between the covering and the contacts of the second set to expose the contacts of the second set in the protective fluid; and engaging the corresponding contacts of the connectors.

16. A method according to claim 15, wherein the contacts engage circumferentially of the connectors.

17. A method according to claim 15, wherein the first connector has a housing with a longitudinal passage therein having a lower end portion in which the contacts of the first set are exposed internally and wherein the contacts of the second set are exposed externally of the second connector to engage the corresponding contacts of the first set when the second connector is inserted into the first connector.

18. A method according to claim 15, wherein contact portions of the first and second connectors have complementary tapers so that a narrower part of the contact portion of the second connector first enters a wider part of the contact portion of the first connector and approaches a narrower part of the contact portion of the first connector during further insertion.

19. A method according to claim 15, wherein when the downhole assembly is set in the well, it is locked in position in the well, and wherein the detaching of the running tool from the first connector comprises breaking a shear pin connection between the running tool and the first connector to permit the running tool to be pulled from the well.

20. A method according to claim 15, wherein the second connector has an externally projecting guide that centralizes the second connector as the second connector is lowered into the well.

21. A method according to claim 15, wherein the electric cable has a sheath that is attached to the second connector so that that the second connector is suspended by the sheath of the electric cable.

* * * * *